US012747126B2

(12) United States Patent
Clarke

(10) Patent No.: US 12,747,126 B2
(45) Date of Patent: Sep. 29, 2026

(54) TAPE DISPENSER

(71) Applicant: Grip Systems Limited, Birmingham (GB)

(72) Inventor: Marcus Clarke, Birmingham (GB)

(73) Assignee: Grip Systems Limited, Birmingham (GB)

( * ) Notice: Subject to any disclaimer, the term of this patent is extended or adjusted under 35 U.S.C. 154(b) by 878 days.

(21) Appl. No.: 17/820,585

(22) Filed: Aug. 18, 2022

(65) Prior Publication Data

US 2023/0057070 A1 Feb. 23, 2023

(30) Foreign Application Priority Data

Aug. 19, 2021 (GB) ..... 2111927

(51) Int. Cl.
*B65H 35/00* (2006.01)
*B65H 20/02* (2006.01)

(52) U.S. Cl.
CPC ..... *B65H 35/0046* (2013.01); *B65H 20/02* (2013.01); *B65H 2301/5142* (2013.01); *B65H 2403/40* (2013.01); *B65H 2404/14* (2013.01); *B65H 2404/19* (2013.01)

(58) Field of Classification Search
CPC ..... B65H 35/0046; B65H 20/02; B65H 2301/5142; B65H 2403/40; B65H 2404/14; B65H 2404/19; B65H 2402/412; B65H 2402/443; B65H 35/0033; B65H 35/0053; B65H 2701/11332; B65H 2701/1944; B65H 35/0066
See application file for complete search history.

(56) References Cited

U.S. PATENT DOCUMENTS

| | | | | |
|---|---|---|---|---|
| 2,405,790 A | | 8/1946 | Krueger | |
| D187,628 S | | 4/1960 | Seiden | |
| 3,131,109 A | | 4/1964 | Auld et al. | |
| 3,156,602 A | | 11/1964 | Fritzinger | |
| D211,762 S | | 7/1968 | Krueger | |
| 5,849,144 A | | 12/1998 | Tang et al. | |
| 5,904,806 A | * | 5/1999 | Mendelovich | B65H 35/0033 156/523 |

(Continued)

FOREIGN PATENT DOCUMENTS

| | | |
|---|---|---|
| GB | 2575712 | 1/2020 |
| WO | 2019220135 A1 | 11/2019 |

*Primary Examiner* — Abbas Rashid
*Assistant Examiner* — Caroline Beha
(74) *Attorney, Agent, or Firm* — Michael Nicholas Vranjes; Harter Secrest & Emery LLP

(57) ABSTRACT

The invention provides a tape dispenser for liquid-activated tape which can be used in handheld or table-top modes. A main body of the dispenser has a rear section for holding a tape reel, and a front section which houses a drive section, a cutter, an activation section, and a main reservoir located below the activation section for holding liquid to activate the tape. A pump is arranged to pump liquid from the main reservoir to the activation section, where in use liquid is applied to the tape to activate it, and means are provided to allow liquid that overflows from the activation section to return to the main reservoir, preferably under gravity. The tape reel is supported by a drum in the rear section, and the drum can be slid out of the rear section to allow the tape reel to be replaced.

20 Claims, 11 Drawing Sheets

(56) References Cited

U.S. PATENT DOCUMENTS

| | | | | |
|---|---|---|---|---|
| D568,399 | S | 5/2008 | Yu Chen | |
| D574,891 | S | 8/2008 | Steele et al. | |
| 7,483,643 | B2 * | 1/2009 | Kougami | G03G 15/6576 399/21 |
| 9,078,546 | B2 * | 7/2015 | Kaufmann | A47K 10/32 |
| D814,565 | S | 4/2018 | Naber | |
| D854,616 | S | 7/2019 | Yu Chen | |
| 2008/0271853 | A1 | 11/2008 | Steele et al. | |
| 2012/0090791 | A1 * | 4/2012 | Blanchfield | B65H 35/0046 156/510 |
| 2014/0026810 | A1 * | 1/2014 | Lazzaroni | B65H 35/0046 118/231 |
| 2018/0371767 | A1 | 12/2018 | Swartz | |
| 2019/0352122 | A1 * | 11/2019 | Magee | B65H 35/0053 |

* cited by examiner

TAPE DISPENSER

CROSS-REFERENCE TO RELATED APPLICATIONS

This application claims the benefit under 35 U.S.C. § 119(b) of United Kingdom Patent Application No. GB2111927.6, filed on Aug. 19, 2021, which application is incorporated herein by reference in its entirety.

FIELD

This invention relates to a tape dispenser, and more specifically to a tape dispenser that can be used with water-activated tape.

BACKGROUND

Tape dispensers are well-known in the packing industry. For example, so-called "tape guns" are available to dispense a range of self-adhesive tapes, and are particularly suitable for polypropylene and brown vinyl tape. Handheld dispensers are known that have a tape holder, a tape feed, and a handle. A cutting mechanism is also provided to enable the tape to be cut away from the tape roll once the tape has been applied to the parcel being packaged. More advanced systems may include a built-in brake that adjusts to accommodate tapes with differing unwind speeds, and to provide extra tension when a more secure bundling, reinforcing, and sealing of parcels is required.

Liquid-activated tape is becoming a more popular packaging tape option than self-adhesive tape. Liquid-activated tape is initially light and non-adhesive, but on application of a liquid, the tape can adhere to packaging. In use, the activated tape bonds with the material of the box and provides a tamper-proof or tamper-evident way of sealing the box, which can be preferable over other forms of adhesive tape. As the liquid used to activate the tape is almost invariably water, the terms "liquid-activated tape" and "water-activated tape" are used interchangeably herein, but it should be noted that the use of liquids other than water is possible.

A disadvantage of using water-activated tape is that a supply of water is required, which is not ideal if the dispenser uses electrical power to dispense and/or cut the tape; it is necessary to ensure that the electrical systems and the water supply systems are isolated from each other. Further, use of water to activate the adhesive capability of the tape can be messy, especially when the user has to apply the tape to the box by hand.

Standard liquid-activated tape dispensers are relatively bulky desk-top items that take care to keep the liquid used to activate the adhesive on the surface of the tape separate from the electrics used to power the dispenser. With these standard liquid-activated tape dispensers, water is applied to the tape, and the tape is cut and dispensed to the user, who must then handle the tape manually and physically press the tape down to maximise contact of the adhesive surface of the tape with the box.

Therefore, embodiments of the present invention are intended to address at least some of the above-described problems and desires.

SUMMARY

In particular, in a preferred aspect of the invention, there is provided a tape dispenser that may be used as a handheld tape dispenser to provide more convenience to the user, and avoiding the need for the user to touch the activated tape with their hands, and that may also be used as a desk-top tape dispenser.

According to a first aspect of the invention there is provided a dispenser for liquid-activated tape, comprising: a main body with a front section and a rear section; wherein the rear section of the main body is arranged to accommodate a reel of liquid-activated tape, and the front section of the main body houses a drive section, a cutter, an activation section, and a main reservoir, wherein in use the liquid-activated tape passes through the drive section, the cutter and the activation section; wherein the main reservoir is located below the activation section and is adapted to hold liquid to activate the tape, the dispenser further comprising a pump arranged to continuously pump liquid from the main reservoir to the activation section, where in use liquid is applied to the tape to activate it, and wherein means are provided to allow liquid that overflows from the activation section to return to the main reservoir.

Providing the main reservoir separately from the activation section means that the activation section needs only to hold enough liquid to activate the tape. Thus, there is less chance of liquid from the activation section entering parts of the dispenser where it could cause damage, such as those areas housing electrical components.

Preferably, liquid that overflows from the activation section returns to the main reservoir under gravity, so that no further means are required to return the liquid to the main reservoir.

Preferably, the activation section includes: a roller for contacting the liquid-activated tape, the outer surface of the roller being porous and capable of absorbing liquid to activate the tape; and a secondary reservoir for holding liquid to activate the tape, the secondary reservoir including: a tray with a lip, the liquid being held in the tray, and walls extending upwardly from the tray to form a trough, the roller being supported by the trough so that the lower part of the roller is located below the lip of the tray.

The provision of a tray with a lip means that the level of liquid in the secondary reservoir can be maintained at a relatively low level, as any liquid pumped into the secondary reservoir when it is full will simply flow over the lip and back to the reservoir.

In a further preferred form, the activation section further includes an overflow section, wherein liquid that flows over the lip of the tray enters the overflow section, and is guided to the main reservoir. The overflow section can be formed separately from the secondary reservoir, which can simplify manufacture.

Preferably, the pump is arranged to continuously pump liquid from the main reservoir to the tray of the activation section. In a preferred form, the liquid enters the tray of the activation section in a direction generally parallel to the axis of rotation of the roller. This avoids the liquid being directed at the roller, which could lead to some parts of the roller being wetter than others.

Preferably, the drive section includes two rollers, the tape passing through the nip of the rollers; the activation section includes two rollers, a roller for contacting the liquid-activated tape and a second roller, the tape passing through the nip of the rollers; and the drive section and the activation section are connected by a gear train, so that a single motor can drive both sections. This reduces the number of electrical components, and so can improve reliability.

Preferably, the rear section of the main body comprises left and right sections extending rearwardly from the sides of the front section of the main body, the lower rear parts of the left and right sections being joined together, such that the space between the left and right sections can accommodate a reel of liquid-activated tape. With this arrangement, the reel of tape is can be easily accessed when it has to be replaced.

In a preferred form, a through-hole is formed in one of the left and right sections, and a recess is formed on the inner surface of the other one of the left and right sections, facing the through-hole. A drum is preferably located in the through-hole, one end of the drum being adapted to be held in the recess on the inner surface of the other one of the left and right sections, the outer diameter of the drum being less than the inner diameter of a reel of liquid-activated tape so that the reel can be supported on the drum. This arrangement allows the reel to rotate on the drum as the tape is drawn off the reel.

Preferably, the drum is arranged to slide in the through-hole, so that the drum be slid out of the space between the left and right sections to allow a tape reel to be replaced.

In a preferred form, the drum is provided with flanges at its ends, the outer diameter of the flanges being greater than the inner diameter of the through-hole so that the drum cannot be removed from the through-hole. This arrangement means that the drum cannot be misplaced or lost when the reel is being replaced.

Preferably, the dispenser is provided with a handle which extends rearwardly from an upper section of the main body, and controls for the dispenser are located on the front face of the upper section of the main body. The controls allowing the dispenser to be used in a handheld mode are preferably located such that they can be used while a user of the dispenser is grasping the handle.

In a preferred form, a rechargeable battery is located within the handle. As the battery is not positioned within the main body of the dispenser, this allows the dispenser to be made more compact.

BRIEF DESCRIPTION OF THE DRAWINGS

The invention will now be described, by way of example only, with reference to the accompanying drawings, in which.

DETAILED DESCRIPTION

It should be noted that the first and second embodiments are very similar; in particular the internal technical features are virtually identical, and so the description of these features applies to both embodiments. The principal differences are that the reservoir of the second embodiment can be removed from the dispenser, whereas the reservoir of the first embodiment cannot be removed, and the way in which the tape reel is retained.

Figure 1:
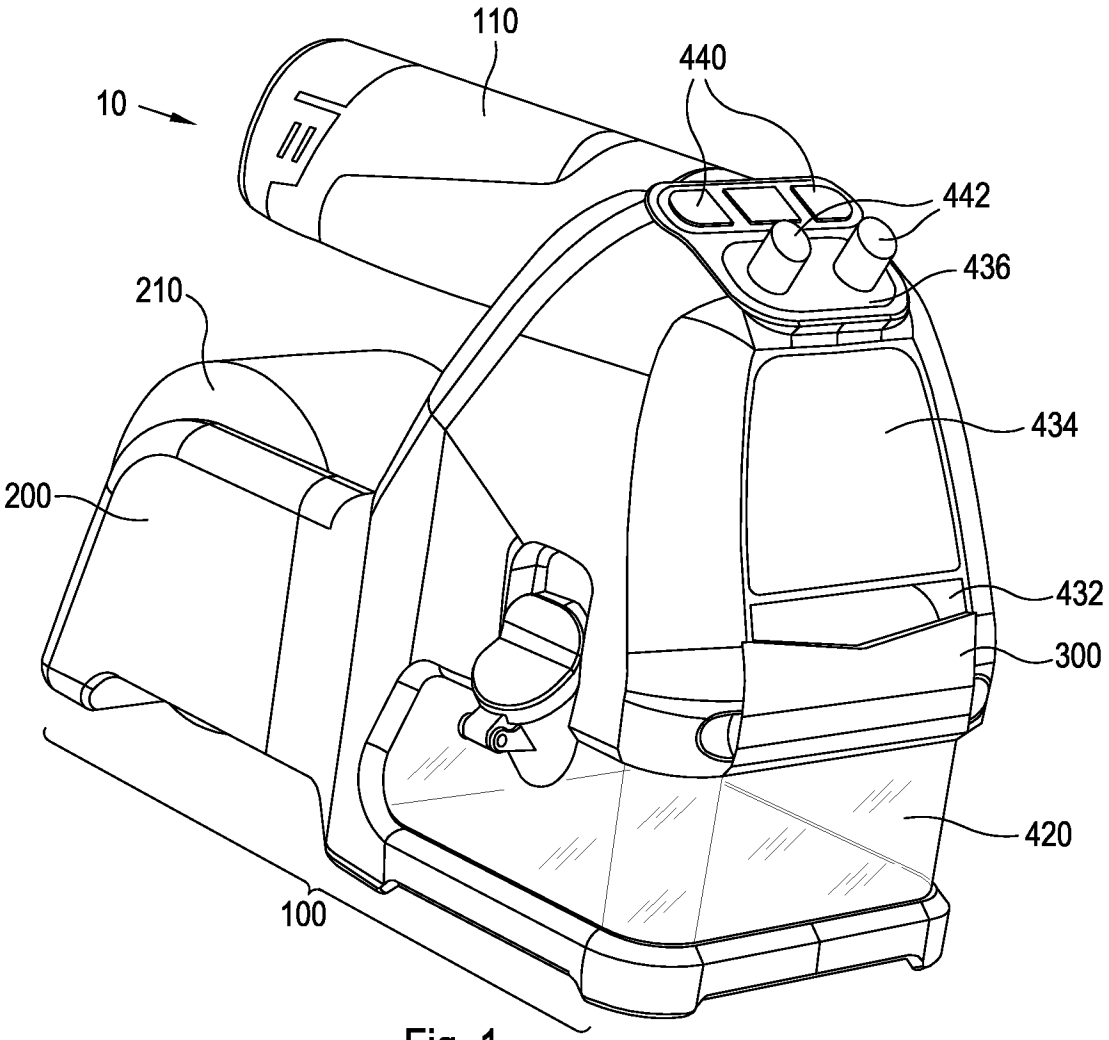
FIG. 1 is a perspective view of a tape dispenser according to a first embodiment of the invention, holding a reel of tape.
Figure 2:
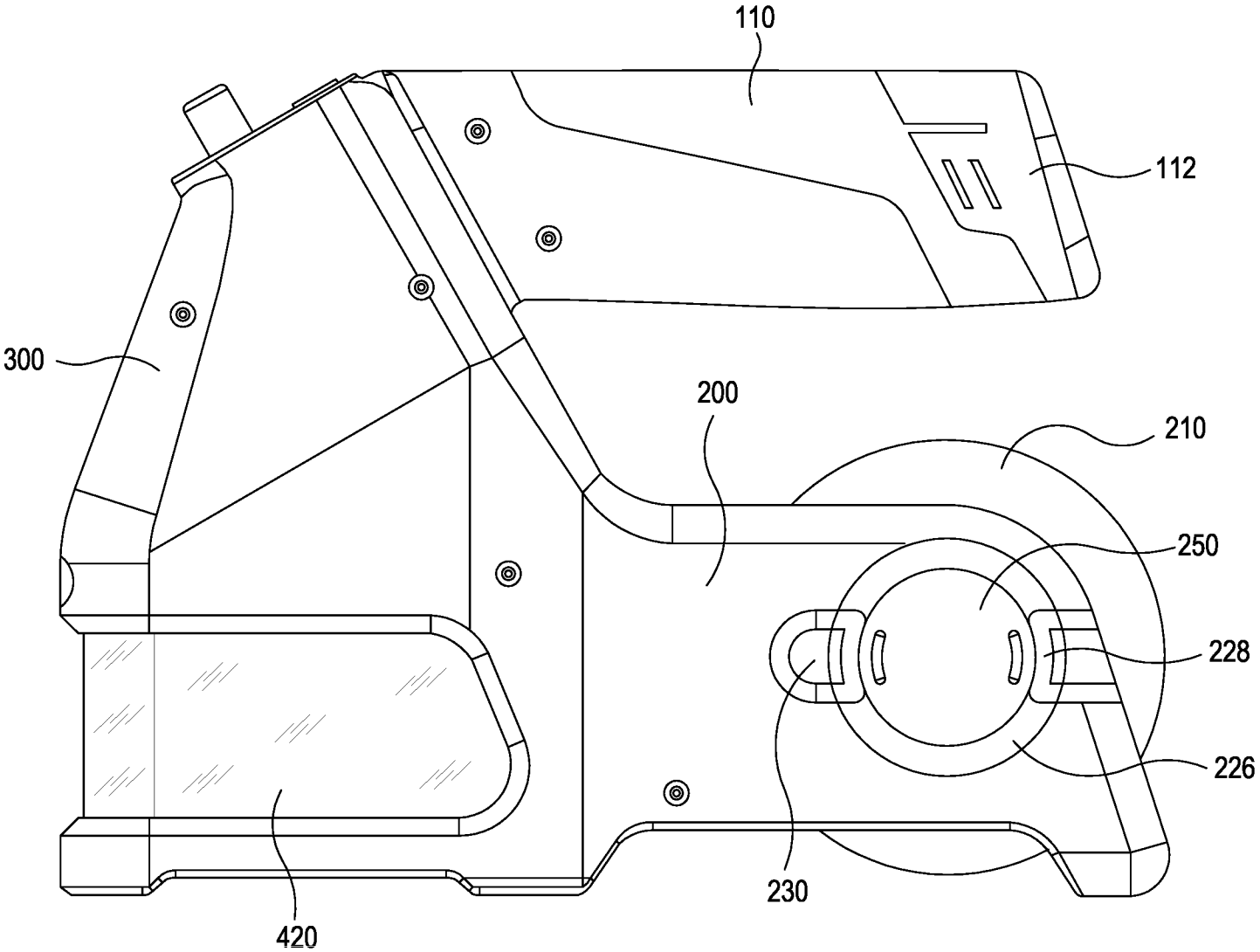
FIG. 2 is a side view of the tape dispenser of FIG. 1.
Figure 3:
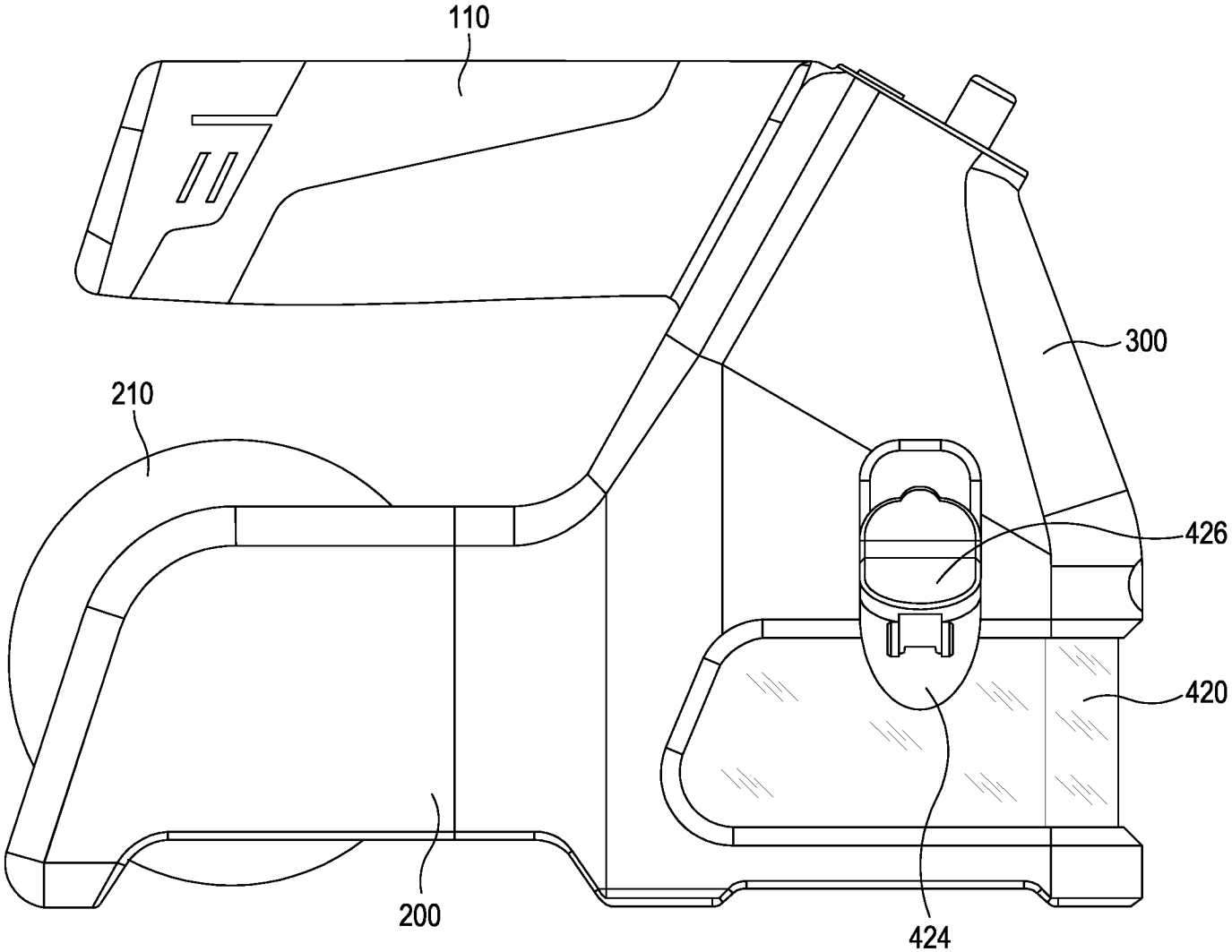
FIG. 3 is a view of the other side of the tape dispenser of FIG. 1.
Figure 4:
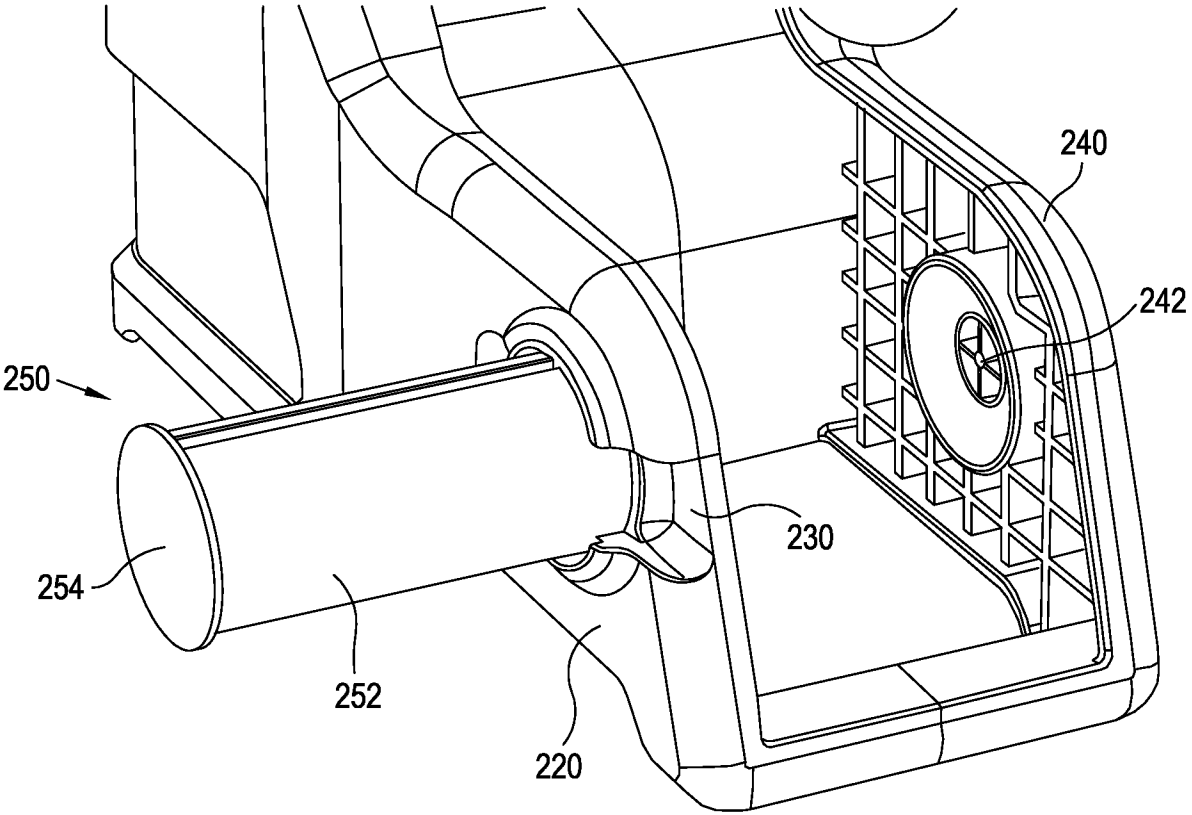
FIG. 4 is a rear perspective view of the tape dispenser of FIG. 1, with the reel of tape removed and the dispenser in position to accept a new reel of tape.

As shown in FIG. 1, a handheld tape dispenser 10 for use with water-activated tape has a main body 100 and a handle 110. The main body 100 includes a rear section 200 which accommodates a reel 210 of water-activated tape, and a front section 300 which houses a drive section 320, a cutter 330, an activation section 340, and a main reservoir 420. The drive section 320, cutter 330, activation section 340 and main reservoir 420 will be described in greater detail later. Water is applied to the tape in the activation section 340. The main reservoir 420 is located in the lower part of the front section 300 of the main body 100, and holds water which can be supplied to the activation section 340. The handle 110 is positioned above the rear section 200 of the main body 100, and houses a rechargeable battery 112 which powers the dispenser 10.

The front section 300 of the main body 100 is formed as a hollow enclosure, with the drive section 320, the cutter 330 and the activation section 340 housed in this hollow enclosure. The handle 110 extends rearwardly from a central upper region of the rear of the front section 300 of the main body 100. Further, the rear section 200 of the main body 100 is formed by left and right sections 220, 240, which extend rearwardly from the left and right edges of the lower region of the front section 300 of the main body 100. A reel 210 of water-activated tape can be accommodated between the left and right sections 220, 240. The water-activated tape 212 is led off this reel 210, through an opening in the rear face of the front section 300 of the main body 100. The tape 212 then passes sequentially through the drive section 320, the cutter 330 and the activation section 340, and is ejected through an opening 432 in the front face 430 of the front section 300 of the main body 100. The front face 430 of the front section 300 of the main body 100 slopes upwardly and rearwardly, and has a steeper section 434 in which the tape ejection opening 432 is located, and a less steep section 436 where controls for the dispenser are located.

If the dispenser is to be used as a handheld tape dispenser, then a user of the tape dispenser grasps the handle 110 to guide the dispenser 10, and more specifically the piece of activated tape 212 being dispensed, to the correct position, so that the piece of activated tape 212 can be guided to the desired position without the user needing to contact the piece of activated tape 212. If the dispenser is to be used as a desk-top tape dispenser, then the user takes the cut piece of tape 212 from the opening 432 in the front face 430 of the front section 300 of the main body 100, and places the piece of tape 212 in the desired position.

The various parts of the dispenser, and their operations, will now be described in more detail.

The handle 110 is generally cylindrical, and shaped and sized to allow it to be grasped comfortably in a user's hand. The handle 110 is bilaterally symmetrical (or at least generally so), so that the dispenser 10 can be used in its handheld mode with equal facility by left-handed and right-handed users.

The handle 110 is hollow and open rearwardly, to allow insertion of a rechargeable battery 112. Contacts are provided within the handle 110 to allow power from the battery 112 to be supplied to the electrical components of the dispenser 10. The removable battery 112 can be removed from the handle 110 and charged in a charging dock, away from the dispenser 10. This has the advantage of ensuring that charging takes place well away from any water in the dispenser 10, so reducing the risk of electric shock. Further, if the battery 112 has been removed for recharging, the absence of the battery 112 from the handle of the dispenser 110 makes it clear to the user that the dispenser 10 cannot be used. In addition, the dispenser 10 can be supplied with two (or more) batteries 112, so that the spare battery (or batteries) 112 can be charging while the dispenser 10 is in use; if the battery 112 in the dispenser 10 runs out of charge, it can simply be swapped for the charged one, and the user can continue to use the dispenser 10 without needing to wait for the battery 112 to be recharged.

The rear section of the main body is formed by left and right sections 220, 240, which extend rearward from the front section 300. The lowermost parts of the left and right sections 220, 240 are connected to each other at the rear of the dispenser 10, to improve strength and rigidity.

A first one of the left and right sections 220, 240 (in the preferred embodiment, the left section 220) is formed with a circular through-hole 222, which accommodates a drum 250. The drum 250 can be slid through the circular through-hole 222, and is formed with flanges 254, 258 at each end that have a larger diameter than the diameter of the through-hole 222, to prevent the drum 250 from being removed from the through-hole 222. The other of the left and right sections 220, 240 (in the preferred embodiment, the right section 240) is formed with a recess 242 that faces the first of the left and right sections 220, and the recess 242 is shaped so that the end of the drum 250 can fit it into it. Preferably, the end of the drum 250 fits into the recess 242 with a releasable snap fit. In use, a tape reel 210 is mounted on the drum 250.

Figure 5:
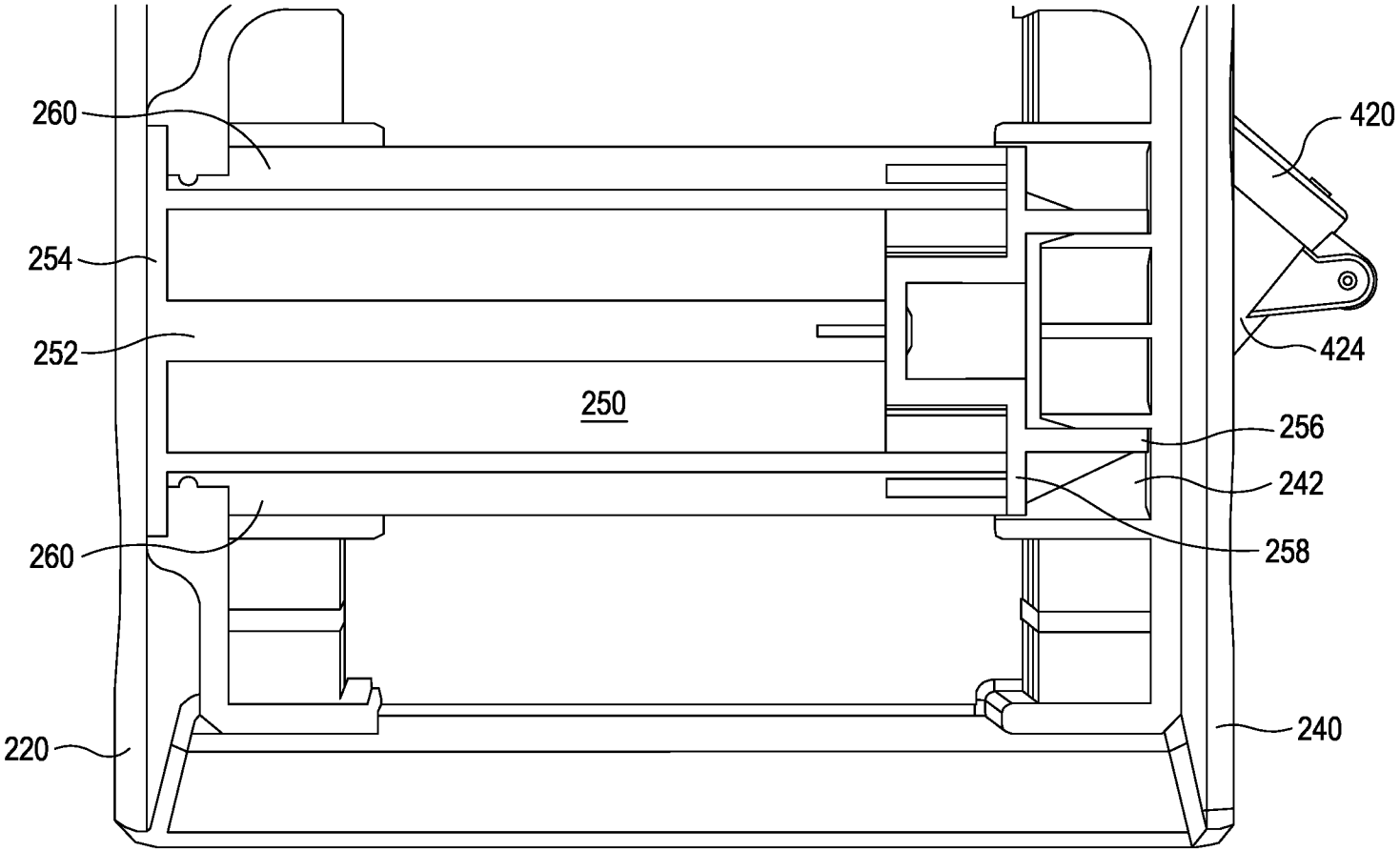
FIG. 5 is a cross-sectional view of the tape reel holder of the first embodiment of the tape dispenser.
Figure 6:
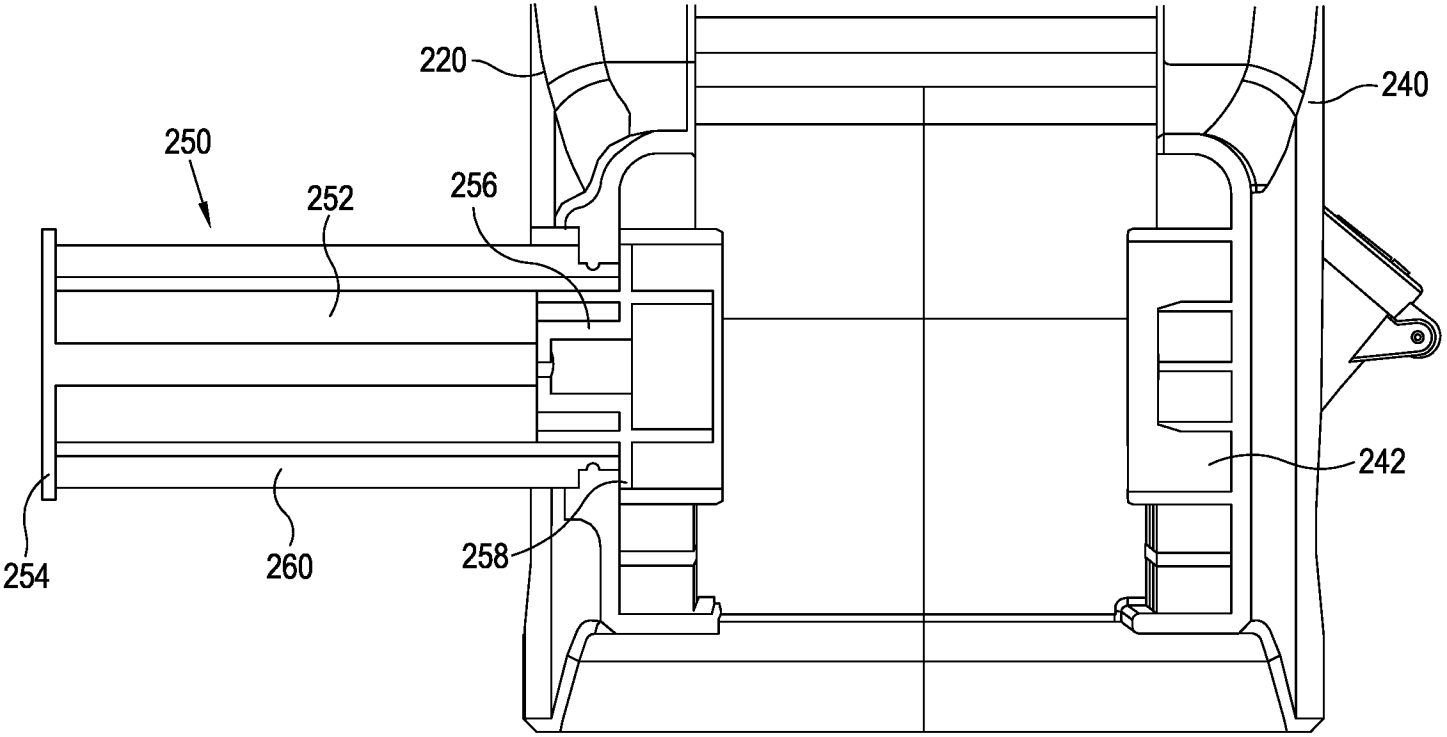
FIG. 6 is a cross-sectional view of the tape reel holder of the first embodiment of the tape dispenser, in an alternative position to allow the dispenser to accept a new reel of tape.
Figure 7:
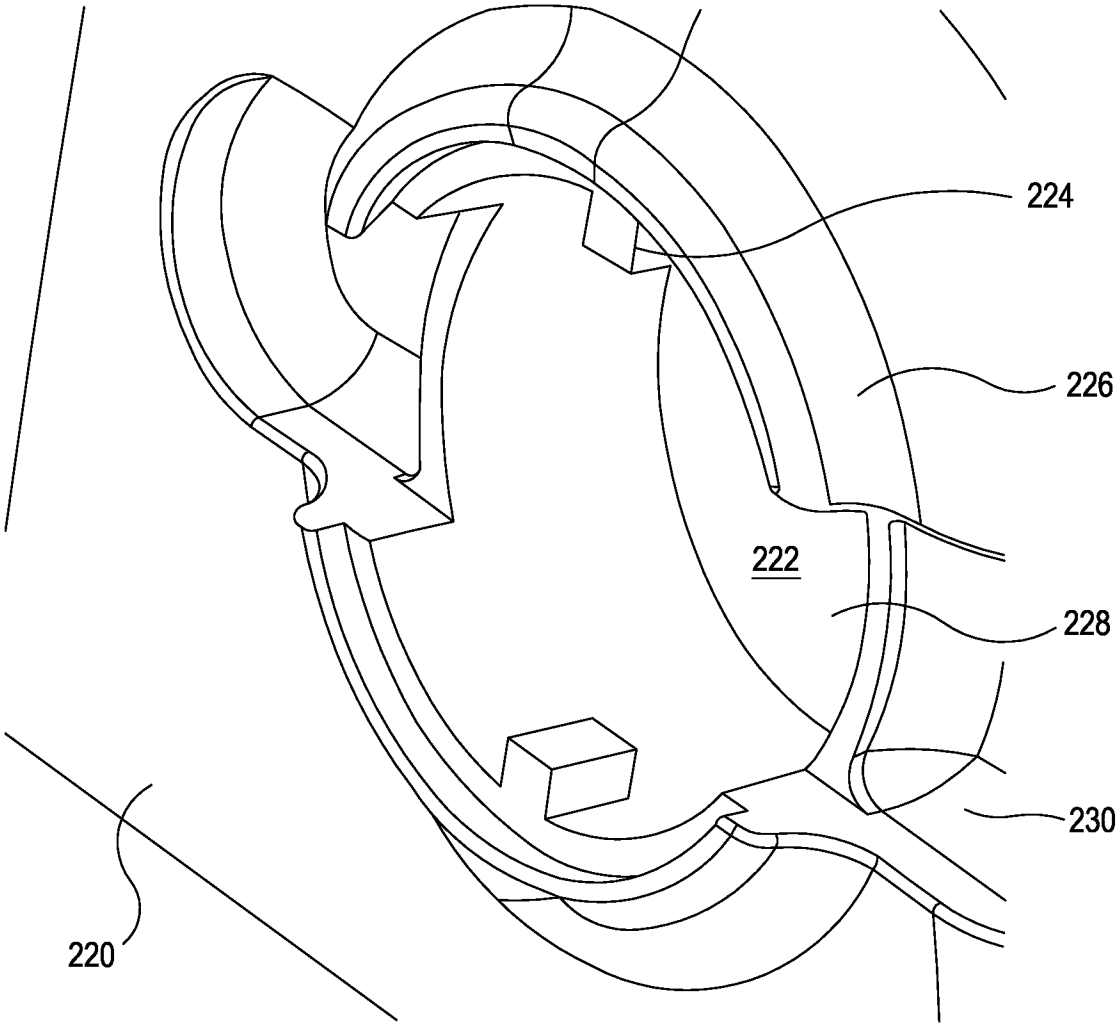
FIG. 7 is an enlarged perspective view of a part of the tape reel holder of the first embodiment of the tape dispenser.
Figure 8:
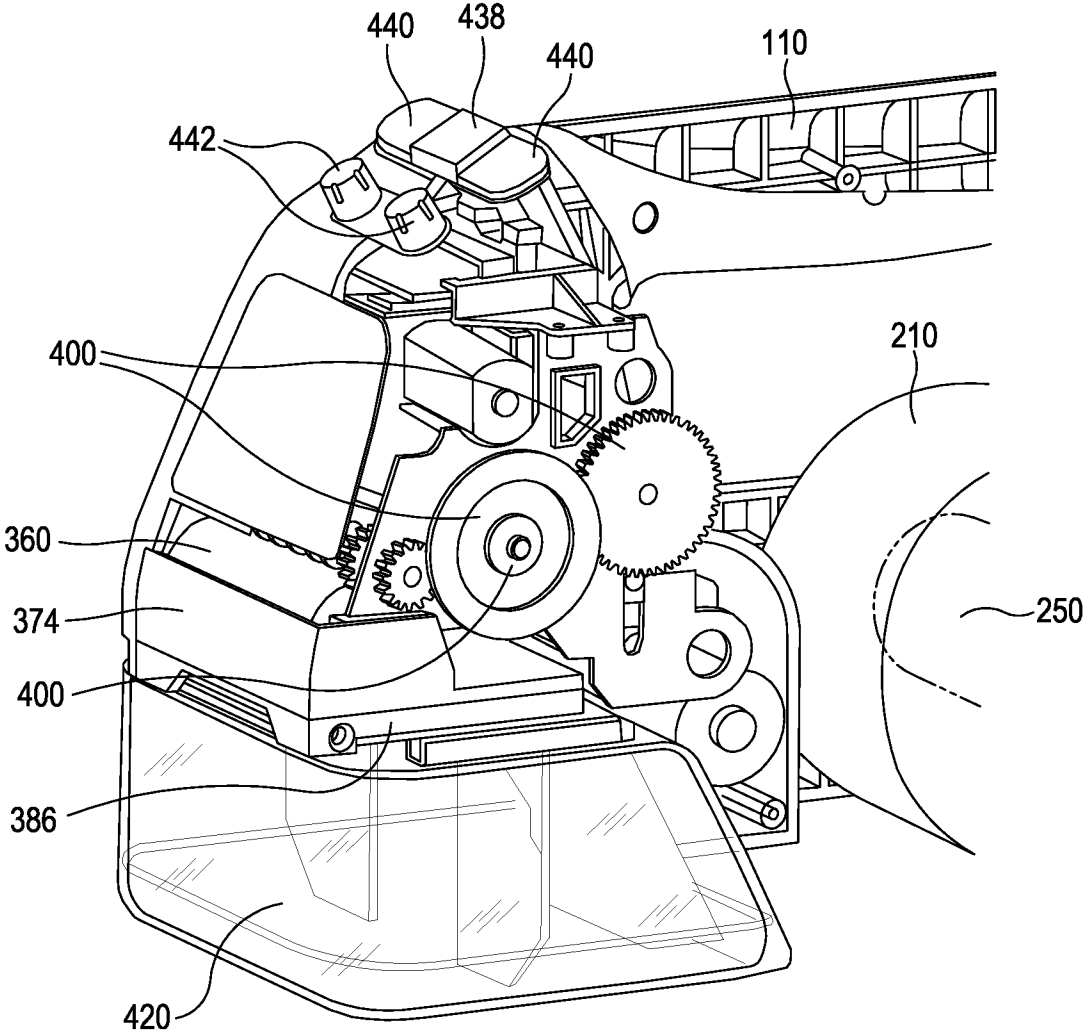
FIG. 8 is a cutaway perspective view of the second embodiment of the dispenser.
Figure 9:
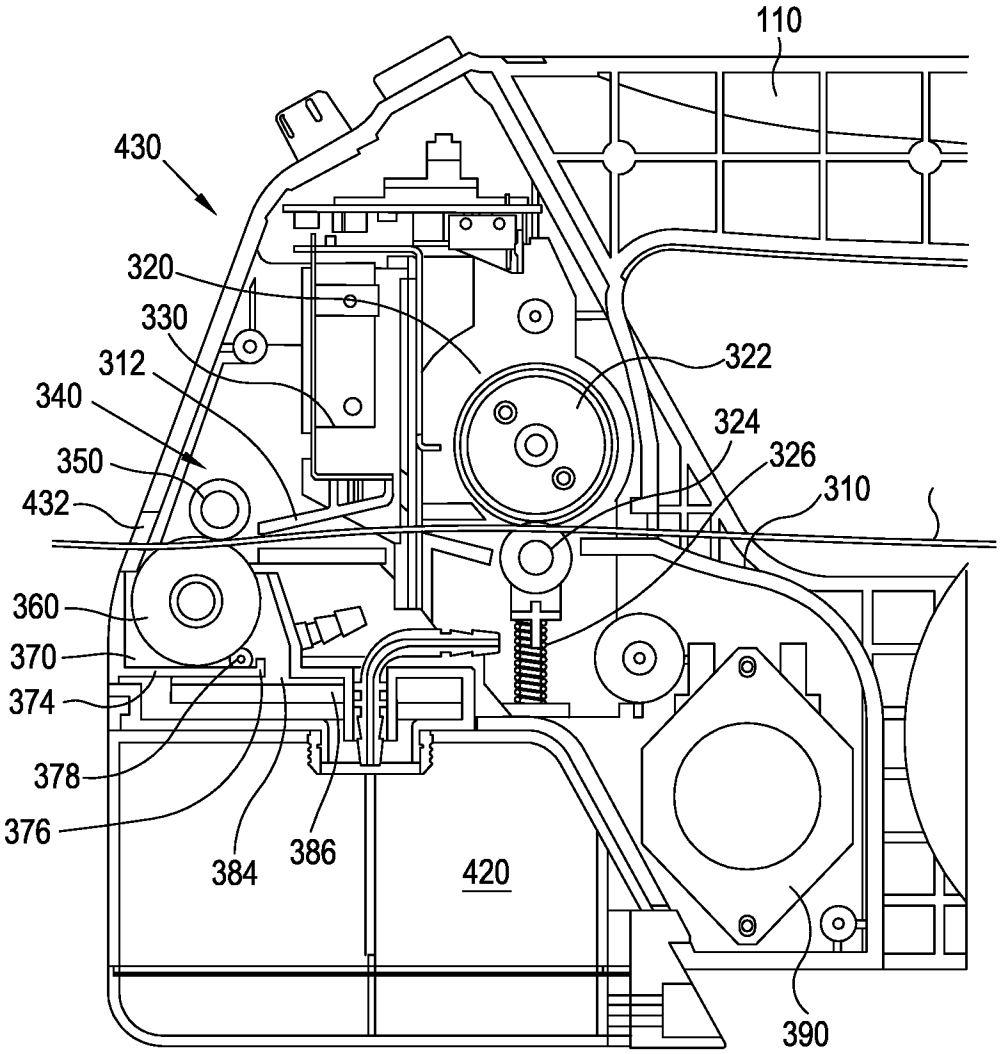
FIG. 9 is a cross-sectional view through the second embodiment of the tape dispenser, showing the path taken by the tape through the dispenser.

As shown in FIGS. 5 and 6, the drum 250 is formed from two parts, a body 252 and an end cap 256. The body 252 is hollow and open at one end. A flange 254 is formed at the other end of the body 252, and in use, this flange 254 faces the outside of the first of the left and right sections 220. The end cap 256 fits into the open end of the body 252, and is also formed with a flange 258.

The drum 252 is formed with diametrically-opposed longitudinal grooves 260 along its outer surface. These grooves 260 interact with projections 224 which project radially inwardly from the inner surface of the through-hole 222, so that the drum 250 is prevented from rotating relative to the through-hole 222.

When the drum 250 is slid out of the through-hole 222, the flange 258 on the end cap 256 comes into contact with the inside of the projections 224 (as shown in FIG. 6), preventing the drum 250 from being removed from the dispenser 10. As the drum 252 cannot be fully removed from the dispenser 10, it cannot be mislaid during the process of changing tape reels.

Further, the through-hole 222 is surrounded by a raised wall 226 on the outside of the first of the left and right sections 220. This raised wall 226 is not continuous; two gaps 228 are provided at the front and rear of the through-hole 222, and these gaps 228 are aligned with shallow recesses 230 formed in the outside of the first of the left and right sections 220, extending forwardly and rearwardly from the through-hole 222. These gaps 226 and recesses 230 allow a user to reach behind the flange 254 with their fingers, to apply force to the drum 250 to release the snap-fit of the end of the drum 250 in the recess 242 formed in the second of the left and right sections 240 so that the drum 250 can slide in the through-hole 222.

When a reel 210 of tape has been exhausted, a user slides the drum 250 sideways through the through-hole 220, to a position where the inner flange 258 comes into contact with the inner face of the first of the left and right sections 220. When the drum 250 is in this position, the drum 250 has been completely withdrawn from the empty reel 210 of tape. The empty reel 210 can be removed from the dispenser 10, and replaced with a full reel. The user then pushes the drum 250 back through the through-hole 222, so that the drum 250 passes through the central hole in the full reel 210, until the end of the drum 250 is located in the recess 242 in the second of the left and right sections 240.

The user can then thread the free end of the tape 212 into the opening in the rear face of the front section 300 of the main body 100. Of course, the user must ensure that the tape is in the correct orientation to be activated in the activation section 340 (in this embodiment, the tape must be arranged such the adhesive-bearing surface is on the lower side of the tape).

Within the housing that forms the front section 300 of the main body 100, there are formed a number of guides 310, 312 to ensure that the tape 212 moves along a desired path within the housing. Specifically, these guides ensure that the tape 212 passes from the opening in the rear face of the front section 300 of the main body 100 to, in sequence, the drive section 320, the cutter 330, the activation section 340, and the opening 432 in the front face 430 of the front section 300 of the main body 10. In a preferred embodiment, the housing includes right and left parts which are formed as plastic mouldings, and the guides 310, 312 extend inwardly from the side walls of the right and left parts.

A first guide 310 directs the tape 212 from the opening in the rear face of the front section 300 of the main body 100 towards the drive section 320, which drives the tape 212 through the dispenser 10. The drive section comprises two rollers 322, 324, and the tape 212 is guided towards the nip of the rollers 322, 324. One of the rollers (in this embodiment, the upper roller 322) is driven to rotate by a drive section motor (not shown), powered by the rechargeable battery 112. The other roller (in this embodiment, the lower roller 324) is not driven, and is pressed against the first roller 322 by a spring 326. The second roller 324 rotates as a result of its contact with the first roller 322 (or the tape 212). Both rollers 322, 324 are formed from a rigid material (such as steel), and are coated with a thin rubber skin, to grip the tape 212 as it enters the nip. Materials other than rubber may be used to form the skin.

The tape 212 is drawn into the nip of the rollers 322, 324 as a result of the rotation of the rollers 322, 324, and the friction between the rubber skin of the rollers 322, 324 and the tape 212. The drive section motor is activated to drive the first roller 322 to rotate when the user depresses a button 438 on the less steep section 436 of the front face 430 of the main body 300. The tape 212 is then guided towards the cutter 330.

The cutter 330 is known from the prior art, and will not be described in detail. The cutter includes an upper and a lower blade, and the tape passes between the blades. One of the blades (in the present embodiment, the lower blade) is fixed in position, and the other blade (in the present embodiment, the upper blade) can be driven to move towards the fixed blade when the user wishes to cut the tape. This movement cuts the tape. Movement of the blade is activated by the user of the dispenser pressing either of two buttons 440 located on the less steep section 436 of the front face 430 of the main body 300.

Motion of the movable blade towards the fixed blade is achieved by means of a motor-driven cam; the motor which drives the cam is separate from the motor that drives the drive section 320. The electronics that control the motors are arranged such that the cutter 330 can only be operated when the motor that drives the drive section 320 is not in operation; that is, the cutter 330 can only operate when the tape 212 is not moving.

The activation section 340 is arranged to apply water to the tape 212 to activate the adhesive on the tape 212. As with the drive section 320, the activation section 340 includes an upper roller 350 and a lower roller 360, and the tape 212 is guided by guide 312 from the cutter 330 towards the nip of the rollers 350, 360. The activation section 340 further includes a secondary reservoir 370 for holding water to wet the lower roller 360, the water being supplied to the secondary reservoir 370 from the main reservoir 420 by means of a pump 390.

The upper roller 350 is connected by a gear train 400 to the driven roller 322 of the drive section 320, and rotates when the driven roller 322 of the drive section 320 rotates. Further, the upper roller 350 and the lower roller 360 of the activation section are connected by gears 352, 362, such that the lower roller 360 also rotates when the upper roller 350 rotates. In the present embodiment, a gear 352 on the upper roller 350 which is driven by the gear train 400 meshes with a gear 362 on the lower roller 360, so that both of the rollers 350, 360 of the activation section 340 are driven to rotate when the driven roller 322 of the drive section 320 is driven to rotate. The gear train 400 is arranged such that the peripheral speed of the rollers 350, 360 of the activation section 340 is slightly higher than the peripheral speed of the rollers 322, 324 of the drive section 320, so that the tape 212 remains taut between the drive section 320 and the activation section 340.

The outer surface 364 of the lower roller 360 is water-absorbent, and in the present embodiment is a sponge. The lowermost part of the outer surface 364 of the lower roller 360 dips into the water in the secondary reservoir 370, and the sponge absorbs water. As the lower roller 360 rotates, the damp part of the sponge is lifted up, and after a half-revolution of the lower roller 360, the damp part of the sponge comes into contact with the lower (adhesive-bearing) surface of the water-activated tape 212, to activate the adhesive. In the meantime, further portions of the sponge surface have been moved through the secondary reservoir 370, and have been wetted in turn. It will be appreciated that this process is continuous, and that in practice the entire outer surface 364 of the lower roller 360 will be damp as long as it rotates.

The distance between the cutter 330 and the activation section 340, and the speeds of rotation of the rollers in the drive section 320 and the activation section 340, are ideally such that the lower roller 360 of the activation section 340 has completed at least half a revolution (so that the part of the lower roller 360 which contacts the lower surface of the tape 212 is damp) by the time the tape 212 has moved from the cutter 330 to the nip of the rollers 350, 360 in the activation section 340. This arrangement means that, when the dispenser 10 is restarted after the tape 212 has been cut, by the time the cut end of the tape 212 reaches the activation section 340, the part of the lower roller 360 which contacts the tape 212 is already damp, and so the adhesive at the cut end of the tape 212 will be activated by the water on the lower roller 360.

The secondary reservoir 370 is arranged to hold water, which is transferred to the tape 212 by the lower roller 360. Furthermore, the combination of the secondary reservoir 370 and the lower roller 360 form an enclosure, from which the water is (at least largely) prevented from escaping.

Figure 10:
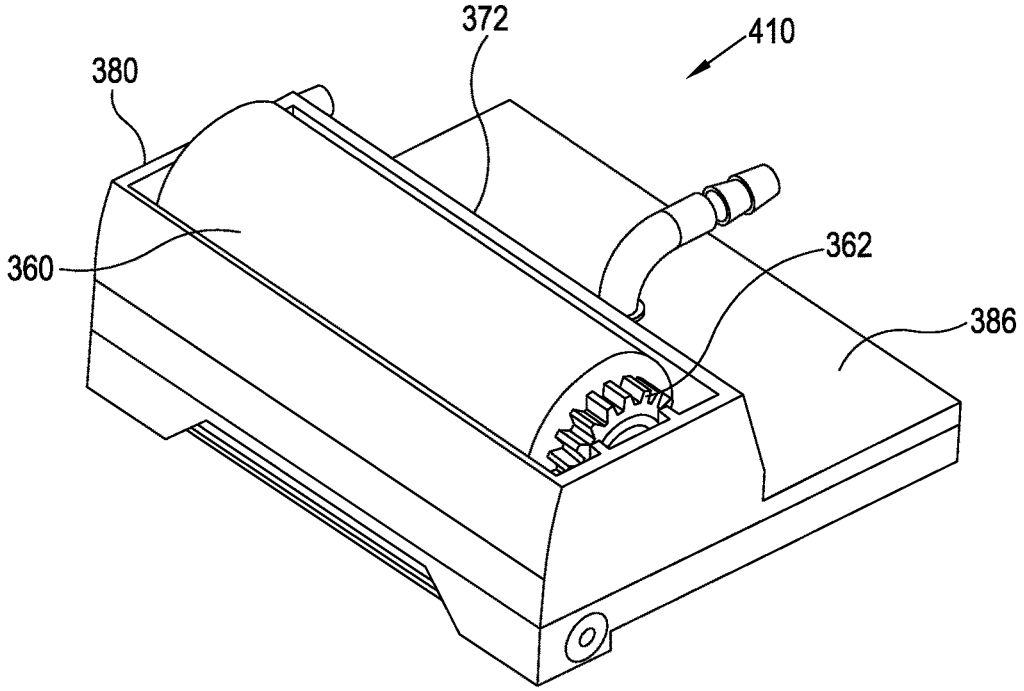
FIG. 10 is a perspective view of part of the activation section of the second embodiment.
Figure 11:
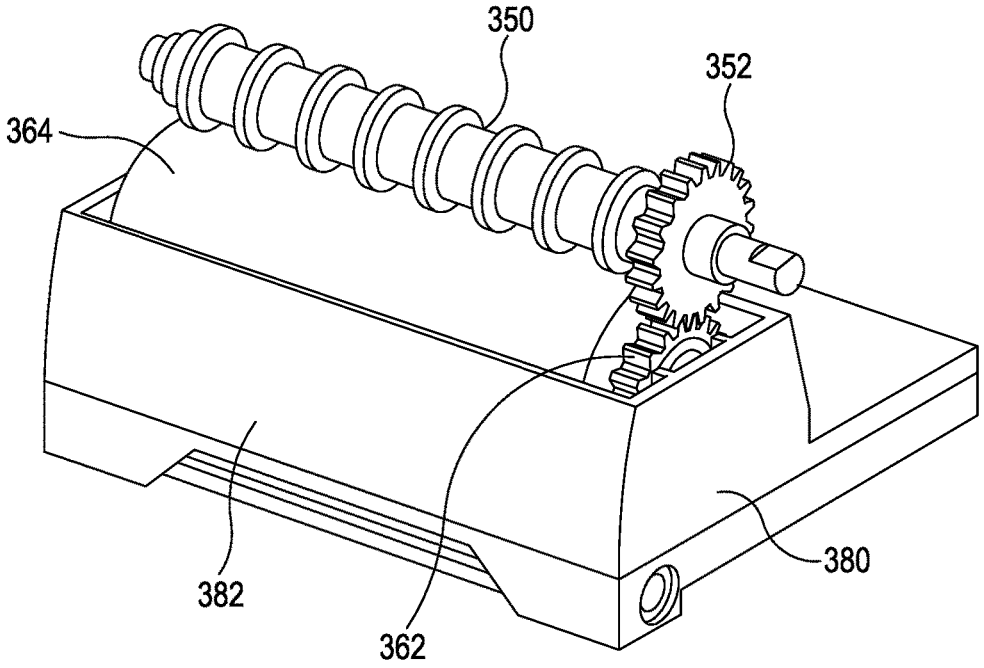
FIG. 11 is a perspective view similar to FIG. 10, showing how the rollers of the activation section interact.
Figure 12:
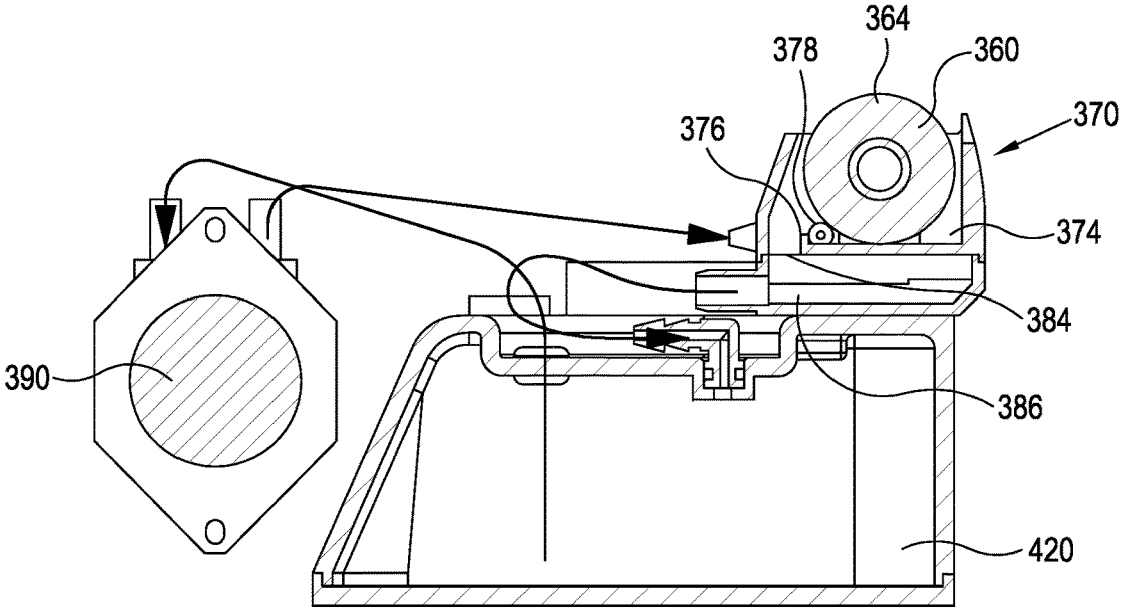
FIG. 12 is a cross-sectional view, showing schematically how water flows between the main reservoir and the secondary reservoir of the first embodiment; and, FIG. 13 is a perspective view, similar to FIG. 12, showing the various pipes that allow water to flow between the main reservoir and the secondary reservoir.

The secondary reservoir 370 is in the form of a trough 372, the size of which corresponds closely to the size of the lower roller 360. The end walls 380 of the trough 372 are arranged close to the end faces of the lower roller 360 (one of which carries the gear 362 which allows the lower roller 360 to be driven), and rotatably support the lower roller 360. Similarly, the side walls 382 of the trough 372 are arranged to be very near to the outer surface 364 of the roller 360, to minimize any gaps through which water can escape. This is best shown in FIG. 10.

Figure 13:
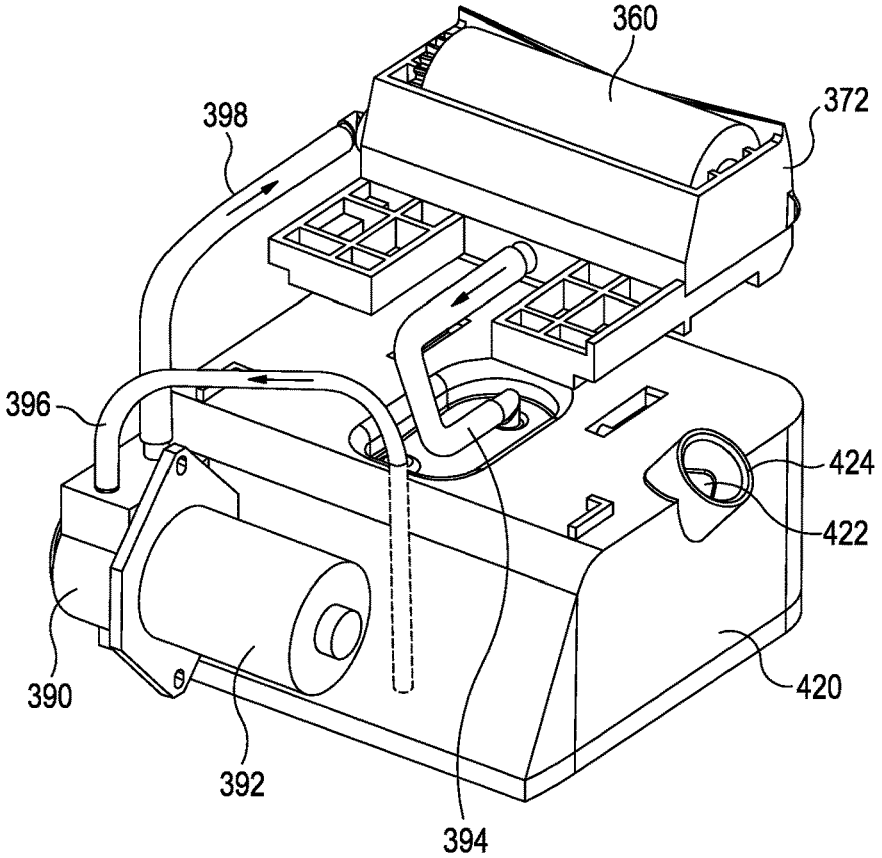

The bottom of the trough 372 is formed as a shallow tray 374, located underneath the lower roller 360. The depth of the tray 374 is such that when it is filled with water, the lower roller 360 will dip into the water and so become wetted. The maximum depth of the water in the tray 374 is limited by the height of a lip 376 of the tray 374; any water beyond that depth will spill over the lip 376 of the tray 374, into a slit 384 formed in the bottom of the trough 372 next to the lip 376. The slit 384 is in communication with an overflow passage 386, which is in turn in communication with the main reservoir 420 through tubing 394 (see FIG. 13), so that any water which overflows from the secondary reservoir 370 is returned to the main reservoir 420.

Water is supplied to the secondary reservoir 370 through an inlet 378 at the lower part of the tray 374. Preferably, the water flowing into the secondary reservoir 370 flows in the direction of the axis of the lower roller 360 into the lower part of the tray 374, rather than flowing directly towards the surface of the roller 360. The intention is for the lower roller 360 to absorb water from the tray 374, rather than for the water to be sprayed directly at the lower roller 360.

The overflow passage 386 and the trough 372 together form a single activation section body 410, which holds the lower roller 360. This activation section body 410 and the lower roller 360 are normally attached to the front section 300 of the main body 100, such that the gear 362 on the lower roller 360 meshes with the gear 352 on the upper roller 350. The activation section body 410 can be removed from the front section 300 of the main body 100, to allow replacement of the lower roller 360 if this becomes damaged or worn. Preferably, the activation section body 410 is held in place by screws, which can be accessed from the outside of the tape dispenser 10. This avoids the risk of accidental or unwanted removal of the activation section body 410. Other retaining means, such as spring-loaded detents, could also be used.

The overflow passage 386 and the trough 372 are formed as separate parts (for example as plastic mouldings), and are connected together to form the activation section body 410. Alternatively, the overflow passage 386 and the trough 372 may be formed as a single body (for example, by 3D printing).

The activation section body 410 is arranged above the main reservoir 420, which as mentioned above is located in the lower part of the front section 300 of the main body 100.

In the present embodiment, the walls of the main reservoir 420 are slightly recessed from the walls of the lower part of the front section 300 of the main body 100, but the walls could be arranged so as to be flush with each other.

The walls of the main reservoir 420 are transparent (or at least translucent), so that a user can see the level of water in the main reservoir 420, and refill it if necessary. An opening 422 is provided at one side of the main reservoir 420 (the right side in the embodiment shown), through which water can be added to the main reservoir 420 as necessary. The opening 422 can be sealed to prevent spillage. In the embodiment shown, the opening 422 in the main reservoir is in communication with a short passage 424 that projects upwardly and outwardly from the side wall of the dispenser 10, and the top end of the short passage 424 is provided with a lid 426 that is hingedly connected to the top end. This hinged connection prevents the lid 426 from being lost during the process of refiling the main reservoir 420.

It will be noted that the front corners of the dispenser 10 and the main reservoir 420 (that is, the regions where the front face 430 meets the side walls) are rounded; sharp edges could cause damage to a parcel being taped shut if they were to come into contact with the parcel during use.

The main reservoir 420 may include internal walls, to prevent the water in the main reservoir 420 from sloshing.

In order to allow water to be transferred from the main reservoir 420 to the secondary reservoir 370, a pump 390 is provided in the main body 100 of the tape dispenser 10. The pump 390 may be a peristaltic pump. An inlet of the pump 390 is in communication with the main reservoir 420 via tubing 396 (see FIG. 13). An outlet of the pump 390 is in communication with the secondary reservoir 370 via tubing 398 (see FIG. 13). As mentioned above, it is preferred for water to enter the secondary reservoir 370 in the direction of the axis of the lower roller 360, which can be arranged by having the water flow through an opening 378 in an end wall 380 of the trough 372.

Further, the overflow passage 386 is in fluid communication with the main reservoir 420 through aforementioned tubing 394. As a result, any water that overflows from the shallow tray 374 that forms the secondary reservoir 370 will flow back into the main reservoir 420 under gravity. It is preferred for the pump 390 to run continuously while the dispenser 10 is operating, so that water is constantly being pumped into the secondary reservoir 370 and returning to the main reservoir 420 via the overflow passage 386, and to this end it is provided with its own motor 392. This arrangement means that the water level in the secondary reservoir 370 (which provides the water that actually wets the water-activated tape 212) is generally constant, even as the water level in the main reservoir 420 drops (since water leaves the dispenser 10 on the activated tape 212). Furthermore, this arrangement avoids the need for control of the pump 390; the pump 390 is always on when the dispenser 10 is operating.

It will be noted that the main reservoir 420 and secondary reservoir 370 (the parts of the dispenser 10 that hold water) are located at a distance from the battery 112. Thus, even if one of the reservoirs 370, 420 were to leak, the water would be unlikely to come into contact with the battery 112 and cause damage.

As mentioned above, the dispenser 10 can be used in handheld and desk-top modes, and controls are provided to make the dispenser 10 easy to use in either mode.

For handheld mode, there is a button 438 to operate the drive section motor and two buttons 440 to operate the cutter 330. These buttons are located toward the top of the less steep section 436 of the sloping front face 430 of the front section 300 of the main body 100, and so can be reached by a user who is grasping the handle 110 of the dispenser 10 with their hand.

For desk-top mode, two knobs 442 are provided, located on the less steep section 436 of the sloping front face 430 of the front section 300 of the main body 100, below the buttons 438, 440 which operate the drive section motor and the cutter 330. One knob controls the speed at which the activated tape 212 is dispensed, and the other knob varies the length of activated tape 212 which is dispensed before the cutter 330 is activated. Preferably, the knobs 442 have discrete settings, and may be arranged to "click" into place. It is also preferred for one of the settings for the length of activated tape 212 dispensed to be continuous (that is, for the activated tape 212 to be dispensed continuously without being cut).

The lower face of the tape dispenser 10 may be provided with rubber pads or the like, to increase the friction between the tape dispenser 10 and whatever surface it is resting on, to reduce the risk of the tape dispenser 10 being accidentally moved during use. The presence of the main reservoir 420 in the lower part of the front section 300 of the main body 100 further increases stability; as water is relatively dense, its presence in the main reservoir 420 will lower the centre of gravity of the tape dispenser 10 and make it less likely to be accidentally knocked over.

It will be appreciated by the skilled person that currently preferred embodiments have been described, and that variations to these embodiments can be made, as long as these variations are within the scope of the appended claims. For example, other forms of cutter may be used, and the details of how the secondary reservoir and the tape reel are attached to the dispenser can be varied.

What is claimed is:

1. A dispenser for liquid-activated tape, comprising:

a main body with a front section and a rear section;

wherein the rear section of the main body is arranged to accommodate a reel of liquid-activated tape, and the front section of the main body houses a drive section, a cutter, an activation section, and a main reservoir, wherein in use the liquid-activated tape passes through the drive section, the cutter, and the activation section;

wherein the main reservoir is located below the activation section and is adapted to hold liquid to activate the tape;

the dispenser further comprising a pump arranged to pump liquid from the main reservoir to the activation section, where in use liquid is applied to the tape to activate it;

wherein means are provided to allow liquid that overflows from the activation section to return to the main reservoir; and wherein the activation section includes:

a roller for contacting the liquid-activated tape, an outer surface of the roller being porous and capable of absorbing liquid to activate the tape; and a secondary reservoir for holding liquid to activate the tape, the secondary reservoir being in the form of a trough.

2. The dispenser as claimed in claim 1, wherein liquid that overflows from the activation section returns to the main reservoir under gravity.

3. The dispenser as claimed in claim 1, wherein in use the liquid is constantly being pumped from the main reservoir to the activation section and returned to the main reservoir.

4. The dispenser for liquid-activated tape as claimed in claim 1, wherein the secondary reservoir for holding liquid to activate the tape includes:

a tray with a lip, the liquid being held in the tray; and walls extending upwardly from the tray to form the trough, the roller being supported by the trough so that the lower part of the roller is located below the lip of the tray.

5. The dispenser for liquid-activated tape as claimed in claim 4, wherein the activation section further includes an overflow section, wherein liquid that flows over the lip of the tray enters the overflow section, and is guided to the main reservoir.

6. The dispenser for liquid-activated tape as claimed in claim 4, wherein the pump is arranged to pump liquid from the main reservoir to the tray of the activation section.

7. The dispenser for liquid-activated tape as claimed in claim 6, wherein the liquid enters the tray of the activation section in a direction generally parallel to the axis of rotation of the roller.

8. The dispenser for liquid-activated tape as claimed in claim 1, wherein:

the drive section includes two rollers, the tape passing through the nip of the rollers;

the activation section includes two rollers, a roller for contacting the liquid-activated tape and a second roller, the tape passing through the nip of the rollers; and the drive section and the activation section are connected by a gear train, so that a single motor can drive both sections.

9. The dispenser for liquid-activated tape as claimed in claim 1, wherein the rear section of the main body comprises left and right sections extending rearwardly from the sides of the front section of the main body, the lower rear parts of the left and right sections being joined together, such that the space between the left and right sections can accommodate a reel of liquid-activated tape.

10. The dispenser for liquid-activated tape as claimed in claim 9, wherein a through-hole is formed in one of the left and right sections, and a recess is formed on the inner surface of the other one of the left and right sections, facing the through-hole.

11. The dispenser for liquid-activated tape as claimed in claim 10, wherein a drum is located in the through-hole, one end of the drum being adapted to be held in the recess on the inner surface of the other one of the left and right sections, the outer diameter of the drum being less than the inner diameter of a reel of liquid-activated tape so that the reel can be supported on the drum.

12. The dispenser for liquid-activated tape as claimed in claim 11, wherein the drum is arranged to slide in the through-hole, so that the drum can be slid out of the space between the left and right sections to allow a tape reel to be replaced.

13. The dispenser for liquid-activated tape as claimed in claim 12, wherein the drum is provided with flanges at its ends, the outer diameter of the flanges being greater than the inner diameter of the through-hole so that the drum cannot be removed from the through-hole.

14. The dispenser for liquid-activated tape as claimed in claim 1, wherein the dispenser further comprises a handle which extends rearwardly from an upper section of the front section of the main body, and wherein controls for the dispenser are located on an upper section of a front face of the front section of the main body.

15. The dispenser for liquid-activated tape as claimed in claim 14, wherein the controls allowing the dispenser to be used in a handheld mode are located such that they can be used while a user of the dispenser is grasping the handle.

16. The dispenser for liquid-activated tape as claimed in claim 14, wherein a rechargeable battery is located within the handle.

17. A dispenser for liquid-activated tape, comprising:

a main body, including a front section operatively arranged to house a drive section, a cutter, an activation section, and a main reservoir; and a rear section operatively arranged to accommodate a reel of liquid-activated tape, wherein in use the liquid-activated tape passes through the drive section, the cutter, and the activation section, wherein the main reservoir is located below the activation section and is adapted to hold liquid to activate the tape;

a pump arranged to pump liquid from the main reservoir to the activation section, where in use liquid is applied to the tape to activate it;

wherein the activation section includes:

a roller for contacting the liquid-activated tape, an outer surface of the roller being porous and capable of absorbing liquid to activate the tape; and a secondary reservoir for holding liquid to activate the tape, the secondary reservoir being in the form of a trough; and an overflow passage in the form of a tray arranged below the secondary reservoir and above the main reservoir, wherein liquid that overflows from the secondary reservoir spills into the tray and is returned to the main reservoir via a conduit extending from the overflow passage to the main reservoir.

18. The dispenser for liquid-activated tape as claimed in claim 17, wherein the tray is aligned with an opening in the secondary reservoir.

19. The dispenser for liquid-activated tape as claimed in claim 18, wherein the secondary reservoir includes a lip arranged adjacent to the opening.

20. A handheld dispenser for liquid-activated tape, comprising:

a main body, including a front section operatively arranged to house a drive section, a cutter, an activation section, and a main reservoir; and a rear section operatively arranged to accommodate a reel of liquid-activated tape, wherein in use the liquid-activated tape passes through the drive section, the cutter, and the activation section, wherein the main reservoir is located below the activation section and is adapted to hold liquid to activate the tape;

a pump arranged to pump liquid from the main reservoir to the activation section, where in use liquid is applied to the tape to activate it;

wherein the activation section includes:

a roller for contacting the liquid-activated tape, an outer surface of the roller being porous and capable of absorbing liquid to activate the tape; and a secondary reservoir for holding liquid to activate the tape, the secondary reservoir being in the form of a trough; and an overflow passage in the form of a tray arranged below the secondary reservoir and above the main reservoir, wherein liquid that overflows from the secondary reservoir is arranged to fall through a conduit into the tray.

* * * * *